US009173512B1

(12) United States Patent
Evans

(10) Patent No.: US 9,173,512 B1
(45) Date of Patent: Nov. 3, 2015

(54) BOWL PLATE

(71) Applicant: Bertha M. Evans, Fort Walton Beach, FL (US)

(72) Inventor: Bertha M. Evans, Fort Walton Beach, FL (US)

( * ) Notice: Subject to any disclaimer, the term of this patent is extended or adjusted under 35 U.S.C. 154(b) by 0 days.

(21) Appl. No.: 14/295,326

(22) Filed: Jun. 3, 2014

(51) Int. Cl.
*A47G 19/02* (2006.01)
*B65D 25/04* (2006.01)
*B65D 21/04* (2006.01)

(52) U.S. Cl.
CPC ..... *A47G 19/02* (2013.01); *B65D 21/04* (2013.01); *B65D 25/04* (2013.01)

(58) Field of Classification Search
CPC ..... A47G 19/02; B65D 25/04; B65D 21/04; B65D 21/0233; B65D 21/0209; B65D 1/36; B65D 1/34
USPC ..... 220/575, 505, 506, 507, 555, 556, 574
See application file for complete search history.

(56) References Cited

U.S. PATENT DOCUMENTS

| | | | | |
|---|---|---|---|---|
| 2,561,022 | A * | 7/1951 | Jones | 220/23.6 |
| 5,593,062 | A * | 1/1997 | Martin | 220/574.1 |
| D418,018 | S * | 12/1999 | Winsted | D7/553.8 |
| 2015/0216338 | A1 * | 8/2015 | Shendelman | |

* cited by examiner

*Primary Examiner* — Stephen Castellano

(57) ABSTRACT

A simulated bowl plate with a bowl placed at the middle or center and a plate placed around the periphery. The plate is connected to the rim of the bowl. The plate has sections for different foods. The bowl plate is capable of being used as a bowl, as a plate or bowl and plate combined. Cold and hot food can be served together on the same dish. The bowl plate saves storage space as less space is occupied as compared to storing bowls and plates.

3 Claims, 1 Drawing Sheet

SECTION B–B

SECTION A–A

SECTION B–B

BOWL PLATE

BACKGROUND OF THE INVENTION

There has always been the plate for certain foods and the bowl for certain foods. If you eat something in a bowl, you get a bowl. If you eat something in a plate, you get a plate.

SUMMARY OF THE INVENTION

The bowl plate is joined together with the bowl in the middle and the plate around the sides of the bowl. There is no inconvenience to the people eating so they don't have to have a separate bowl and a separate plate for their foods. The multipurpose bowl plate is arrayed in radiation manner by taking the center bowl as a benchmark. The plate is divided into four accommodation sections. You can have different type of foods, hot or cold. A bowl plate is a technical solution and a kind of multipurpose bowl plate. The plate is a sectional plate for a variety of foods. The bowl plate is designed for serving cold cereal-fruit, hot soup, other food that you would use with a regular bowl and plate. The invention is a bowl and plate combined together.

DRAWING DESCRIPTION

DETAILED DESCRIPTION OF THE INVENTION

Figure 1:
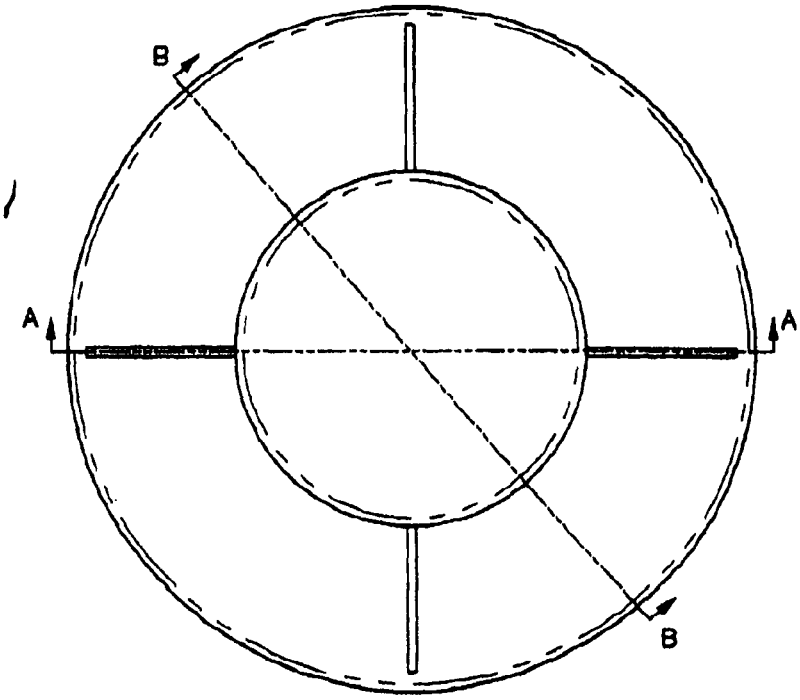
FIG. 1 is a plan view depicting the sectioning planes of the cross sections of FIGS. 2 and 3.
Figure 2:
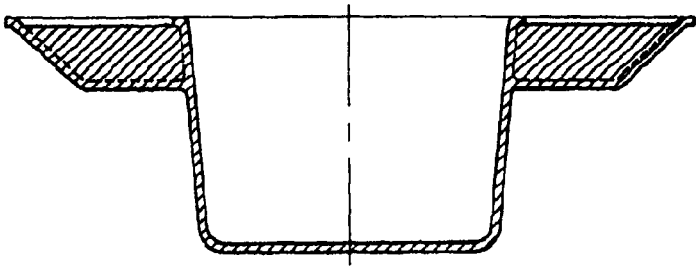
FIG. 2 is a side cross sectional view through partitions.
Figure 3:
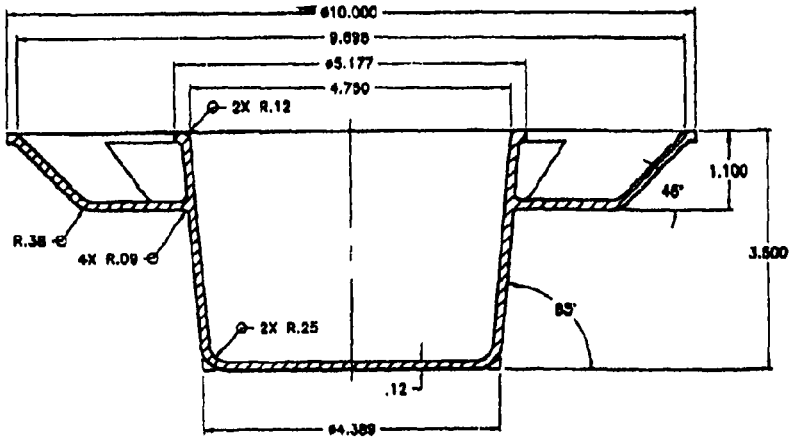
FIG. 3 is a side cross sectional view which doesn't section the partitions.

The invention is a combination bowl and plate for food. The bowl section defines a central cylindrical shaped section. The plate section defines a peripherally positioned, annular section which surrounds the bowl section. The bowl section defines a central compartment designed for either hot food such as soup or cold food such as cold cereal. The plate section defines a flat horizontal surface for supporting food adjacent to the bowl section. The plate and bowl sections are permanently connected together.

The plate is divided into four equally sized and similarly shaped compartments by four permanently connected partitions which extend upwardly from the upper surface of the plate and extend radially outwardly from the bowl section to an outer pate sidewall. The upper edges of the partitions lie in a first horizontal plane that is below a second horizontal plane flush with the uppermost surfaces of the bowl sidewall and the outer plate sidewall.

The bowl sidewall and the outer plate sidewall have outwardly extending reinforcing ledges adjacent their uppermost surfaces. The outer plate sidewall extends upwardly and outwardly from said flat horizontal surface on an angle of inclination of 135 degrees. The outer diameter of the plate is greater than twice the outer diameter of the bowl and less than three times the outer diameter of the bowl. The bowl extends beneath the lowermost surface of the plate by a distance which is greater than twice the plate height and less than three times the plate height. The lowermost surface of the plate is annular and flat with no recessed cavities.

The invention claimed is:

1. A combination bowl and plate for food, the combination bowl and plate comprising:

A bowl defining a central, cylindrically shaped section; and

A plate defining a peripherally positioned, annular section which surrounds said bowl;

Said bowl defining a central compartment designed for either hot food such as soup or cold food such as cold cereal;

Said plate defining a flat horizontal surface for supporting food adjacent to said bowl;

said plate and bowl are permanently connected together, said plate having permanently connected partitions which extend radially outward from said bowl to an outer plate sidewall, the upper edges of the partitions lie in a first horizontal plane that is below a second horizontal plane flush with the uppermost surfaces of the bowl sidewall and the outer plate sidewall, the bowl sidewall and the outer plate sidewall have outwardly extending reinforcing ledges adjacent their uppermost surfaces, the outer plate sidewall extends upwardly and outwardly from said flat horizontal surface on an angle of inclination of 135 degrees, the outer diameter of the plate is greater than twice the outer diameter of the bowl and less than three times the outer diameter of the bowl, said bowl extends beneath the lowermost surface of the plate by a distance which is greater than twice the plate height and less than three times the plate height, the lowermost surface of the plate is annular and flat with no recessed cavities.

2. The combination bowl and plate according to claim 1, wherein the bowl sidewall extends upwardly and outwardly from the bowl bottom on an angle of inclination of 95 degrees.

3. The combination bowl and plate according to claim 1, wherein there are four of said outwardly extending partitions and the plate has four compartments.

* * * * *